United States Patent [19]

Ballah et al.

[11] 4,172,913

[45] Oct. 30, 1979

[54] ARTIFICIAL CHRISTMAS TREE STRUCTURE

[76] Inventors: Clark Ballah, 480 Richards Rd., Kansas City, Mo. 64116; Hollis A. Jay, 7611 E. 108th St., Kansas City, Mo. 64134

[21] Appl. No.: 836,090

[22] Filed: Sep. 23, 1977

[51] Int. Cl.[2] ..... A47G 33/06

[52] U.S. Cl. ..... 428/9; 428/20; 211/196; 403/109

[58] Field of Search ..... 428/8, 9, 18, 19, 20; 52/632; 156/61; 211/196, 205; 403/107, 109, 112

[56] References Cited

U.S. PATENT DOCUMENTS

| | | | |
|---|---|---|---|
| 843,712 | 2/1907 | Straub | 428/18 X |
| 918,579 | 4/1909 | Murch | 403/178 X |
| 989,069 | 4/1911 | Siewert | 52/632 |
| 1,151,810 | 8/1915 | Moore | 43/109 X |
| 1,581,325 | 4/1926 | Sands | 403/300 |
| 1,694,974 | 12/1928 | Glover | 428/8 |
| 2,217,188 | 10/1940 | Snyder | 403/109 X |
| 3,115,435 | 12/1963 | Abramson | 428/8 |
| 3,219,512 | 11/1965 | Kovacevic | 428/19 X |
| 3,616,102 | 10/1971 | Baus | 428/20 |
| 3,674,612 | 7/1972 | Gehl, Jr. | 428/19 X |
| 3,928,689 | 12/1975 | Mottel | 428/20 X |
| 4,062,156 | 12/1977 | Roth | 52/632 X |

FOREIGN PATENT DOCUMENTS

| | | | |
|---|---|---|---|
| 1057955 | 2/1967 | United Kingdom | 403/112 |

*Primary Examiner*—Henry F. Epstein
*Attorney, Agent, or Firm*—Armstrong, Nikaido, Marmelstein & Kubovcik

[57] ABSTRACT

A telescoping artificial tree having a display stand and a centrally located base portion within the display stand and extending therefrom a support tube or rod surrounded by a plurality of tubing cylinders each having a support collar, with the cylinders located sequentially, concentrically and axially in a spaced relation to one another such that the diameter of each cylinder decreases inwardly toward the support tube or rod, with the support collar having a hinge slot and locking notch adapted to receive a hinge base with a locking tab respectively where the hinge base is adapted to receive a hinge extension to form a hinge assembly such that the limbs of the tree extend from the hinge extension when located therein.

6 Claims, 11 Drawing Figures

ARTIFICIAL CHRISTMAS TREE STRUCTURE

BACKGROUND OF THE INVENTION

The present invention relates to a telescoping artificial tree which is a structure designed especially for use in the artificial Christmas tree industry, to permit the fast and efficient erection of an artificial tree, such as a Christmas tree, while permitting simple, convenient and compact storage of the tree between uses or for shipment.

In the past, in the artificial tree industry, and particularly that portion of the industry relating to Christmas trees, there have been serious problems and difficulties relating to the convenience in setting up and erecting artificial trees together with storage and ease and speed in constructing the tree.

Attempts to remedy the defects and drawbacks of past structures in the artificial tree, and particularly the Christmas tree industry, have centered around the trunk as well as the connecting elements and the branches themselves in relation to the trunk. These efforts have resulted in some progress and improvement but not to the extent or in relation to the character of the present invention.

The primary object of the present invention is to provide a device which will overcome the problems and deficiencies associated with past artificial trees, and particularly artificial Christmas trees.

Another object of the present invention is to provide an artificial tree, and particularly an artificial Christmas tree, which includes a trunk composed of a plurality of telescoping, tubular, cylinder members with related supported structures designed to readily, easily and conveniently extend to produce a completed artificial tree structure.

Another object of the present invention is further to provide such a structure wherein the branches are pivotally connected to the trunk in such a manner as to permit easy folding and storage in relation to the telescoping trunk when collapsed.

A still further object of the present invention is to provide an artificial tree, and particularly an artificial Christmas tree, which is adaptable to and capable of being a sturdy structure which can be constructed in a fast and efficient manner while being collapsed for convenient and compact storage with equal ease and convenience as well as speed.

Yet another object of the present invention is to provide a structure of the class indicated which is capable of the functions and operations referred to and which is based upon sound mechanical principals wherein an artificial tree, and particularly an artificial Christmas tree, may be easily and conveniently constructed and collapsed for storage and/or shipment.

Other objects will appear hereinafter.

SUMMARY OF THE INVENTION

A telescoping artificial tree having a display stand and a centrally located base portion within the display stand and extending therefrom a support tube or rod surrounded by a plurality of round tubing cylinders each having a support collar with the cylinders located sequentially, concentrically and axially in a spaced relation to one another such that the diameter of each cylinder decreases inwardly toward the support tube or rod, with he support collar having a hinge slot and locking notch adapted to receive a hinge base with a locking tab respectfully where the hinge base is adapted to receive a hinge extension to form a hinge assembly such that the limbs of the tree extend from the hinge extension when located therein.

The hinge assembly is comprised of a hinge base connected by a rivet to a hinge extension, which may preferably be in the form of a sleeve and which is adapted to receive the limbs which form part of the tree. Moreover, the support collar has projections extending therefrom which are designed to fit into the space between the respective, concentrically located, cylinders. The number of hinge slots in the support collar can be varied to accommodate any desired number of base hinge assemblies depending on the type and nature of the tree and the fullness desired, or the like. Further, the hinge base contains as part of its structure a locking tab adapted to cooperate with the locking notch in the support collar associated with each hinge slot. This locks the hinge assembly to the support collar and the riveted character of the hinge base and hinge extension permit a pivotal relationship between these elements.

In the assembly, "O"-rings are located in the space between the concentrically arranged cylinders to support and adjust the clearance therebetween. The "O"-rings cooperate with stop rings associated with each cylinder.

DESCRIPTION OF THE DRAWINGS

For a more complete understanding of the present invention, reference will be made to the attached drawing figures forming a part of the present application.

DETAILED DESCRIPTION OF THE DRAWINGS

Figure 1:
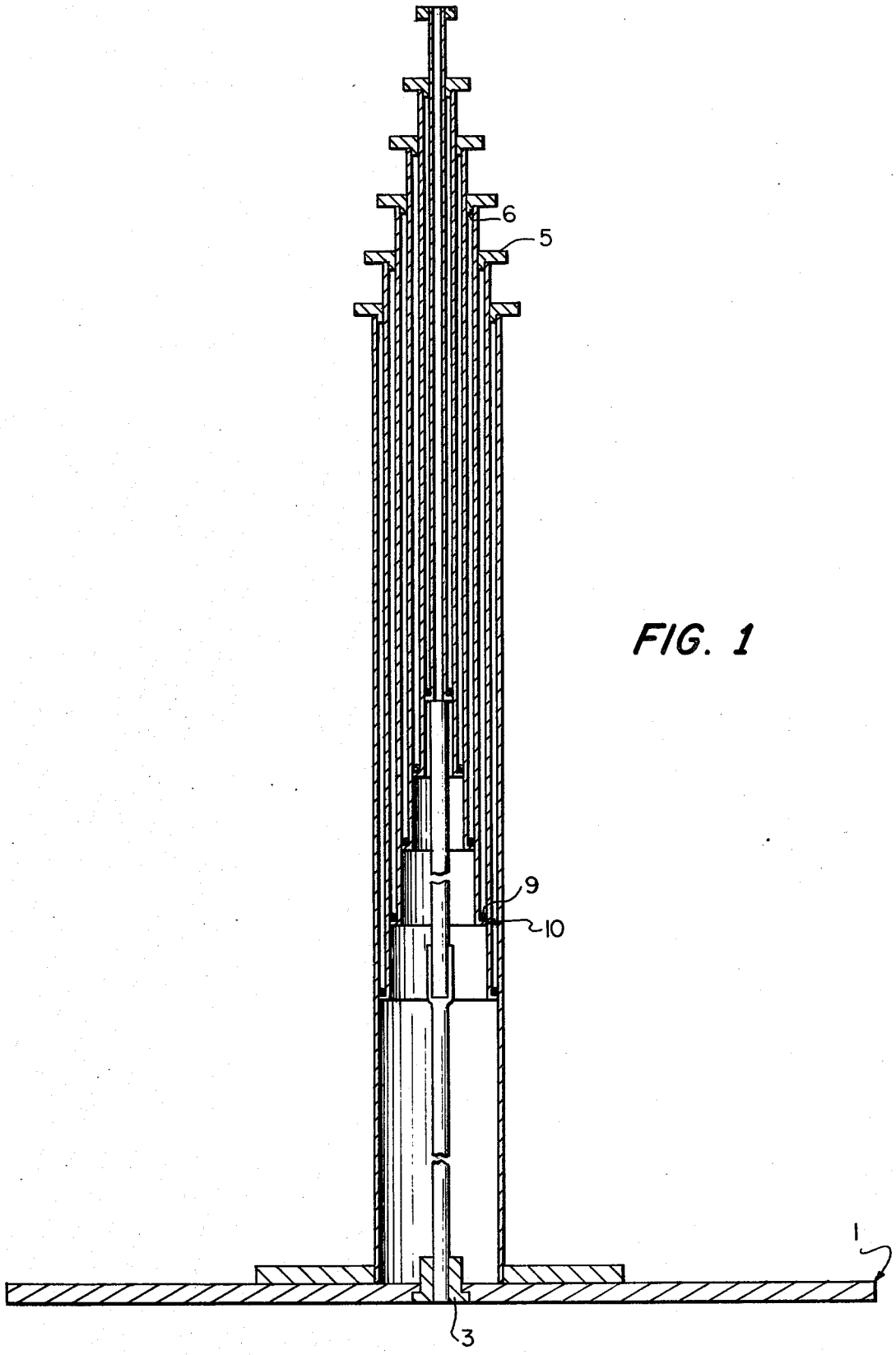
FIG. 1 is a side view in cross-section of the principal features of the present invention arranged in a collapsed state.
Figure 2:
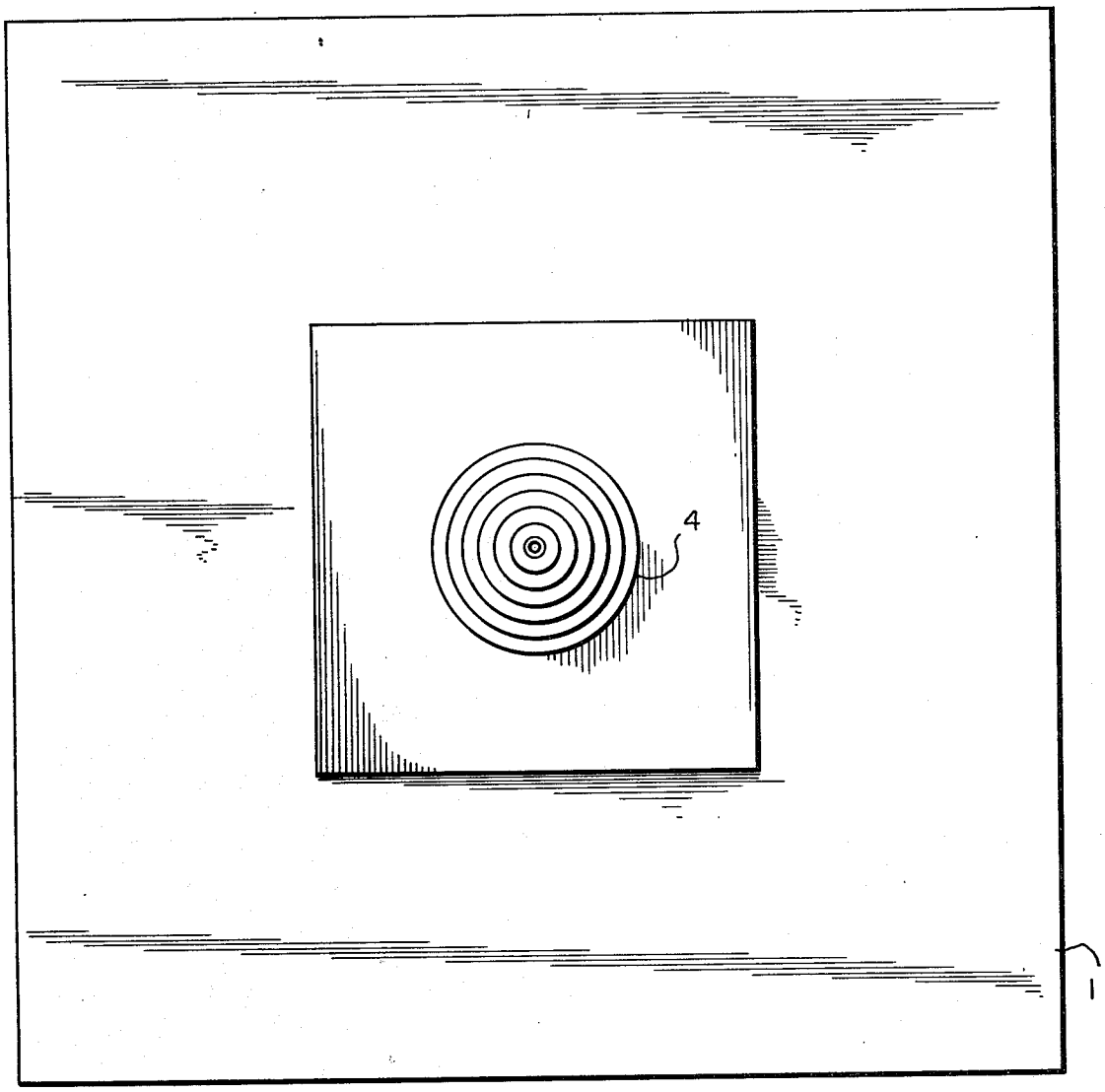
FIG. 2 is a top view of the principal structure of the present invention.

Referring now to the Figures and the details of the construction and operation of the present structure, numerals 1 to 20 refer to the parts of the structure. Numeral 1 is a display stand upon which the entire tree structure sits. Numeral 2 is a support tube or rod which may be in two or more sections such that each section fits co-axially into the other by so constructing the matching ends thereof that the respective diameters can fit one within the other to be held by friction. Numeral 3 is the base upon which the support rod or tube 2 is held and the base 3 is located within the display stand. The base 3 may preferably be molded to the rod or tube 2.

Numeral 4 refers to a plurality of round tubular cylinders of varying diameters which are located axially, sequentially and concentrically in a spaced relation to one another such that each cylinder, respectfully has a decreasing diameter toward the support tube 2. The cylinders 4 are thus located in spaced relationship axially and are separated by a stop ring 10 with "O"-rings 9 located in the space separating these cylinders for support and to adjust the clearance therebetween.

Each cylinder 4 has attached thereto a support collar 5 with an extension member 6 located perpendicularly thereto and designed to fit in the space between adjacent cylinders.

The support collar 5 contains a hinge slot 7 and locking notch 8 adapted to receive respectively, hinge base 13 and locking tab 17 located thereon.

The hinge base contains a first rivet hole 15 adapted to correspond with second rivet hole 16 in the hinge extension 14 which then can be attached to the hinge base 13 to form a hinge assembly 11 whereby the hinge extension 14 can pivot in a restricted manner to be angularly located in relation to the support collar 5. The hinge extension 14 may preferably be in the form of a sleeve adapted to recevie a limb 20. The plurality of support collars 5 with a plurality of hinge slots 7 upon receiving hinge assemblies with limbs completes the tree. The number of limbs 20 may be varied according to the fullness desired.

The hinge extension member 14 is designed through crimping slots 19 to receive a limb 20 therein.

Thus, when the tubular cylinders 4 are respectively extended, the hinge assembly 11 permits limbs 20 to be extended in an angular relationship to the support collar 5 and when the cylinders 4 are retracted, the pivotal relationship of hinge extension 14 to hinge base 13 by a rivet through first rivet hole 15 and second rivet hole 16 permits the hinge extension 14 with branch 20 therein to be located in a more or less parallel relation with cylinders 4 to be stored therewith conveniently. Alternatively, the limbs 20 may be separately removed.

Figure 8:
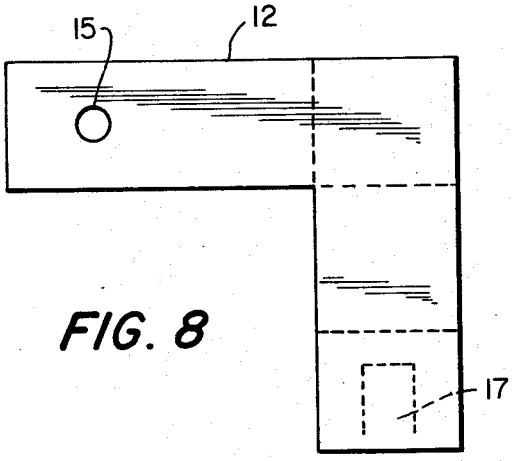
FIG. 8 is a front view of the hinge base in an unfolded condition.
Figure 9:
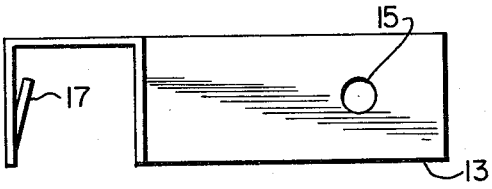
FIG. 9 is a side view of the hinge base in a completed condition.
Figure 10:
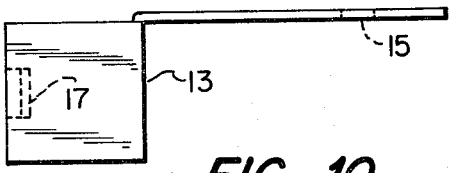
FIG. 10 is a top view of the hinge base in a completed condition.
Figure 7:
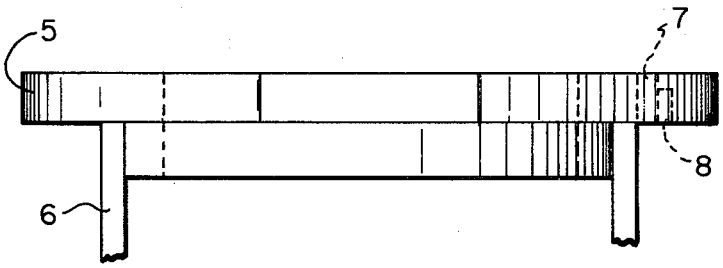
FIG. 7 is a side view of the support collar.
Figure 11:
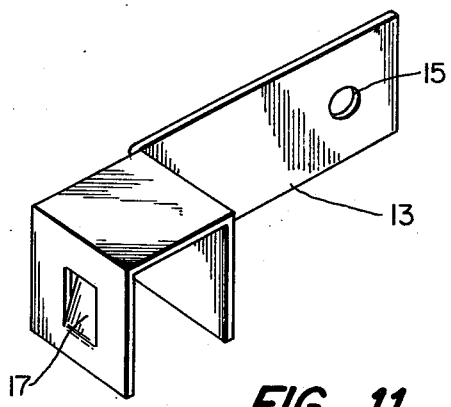
FIG. 11 is a perspective view of the hinge base in completed condition.
Figure 3:
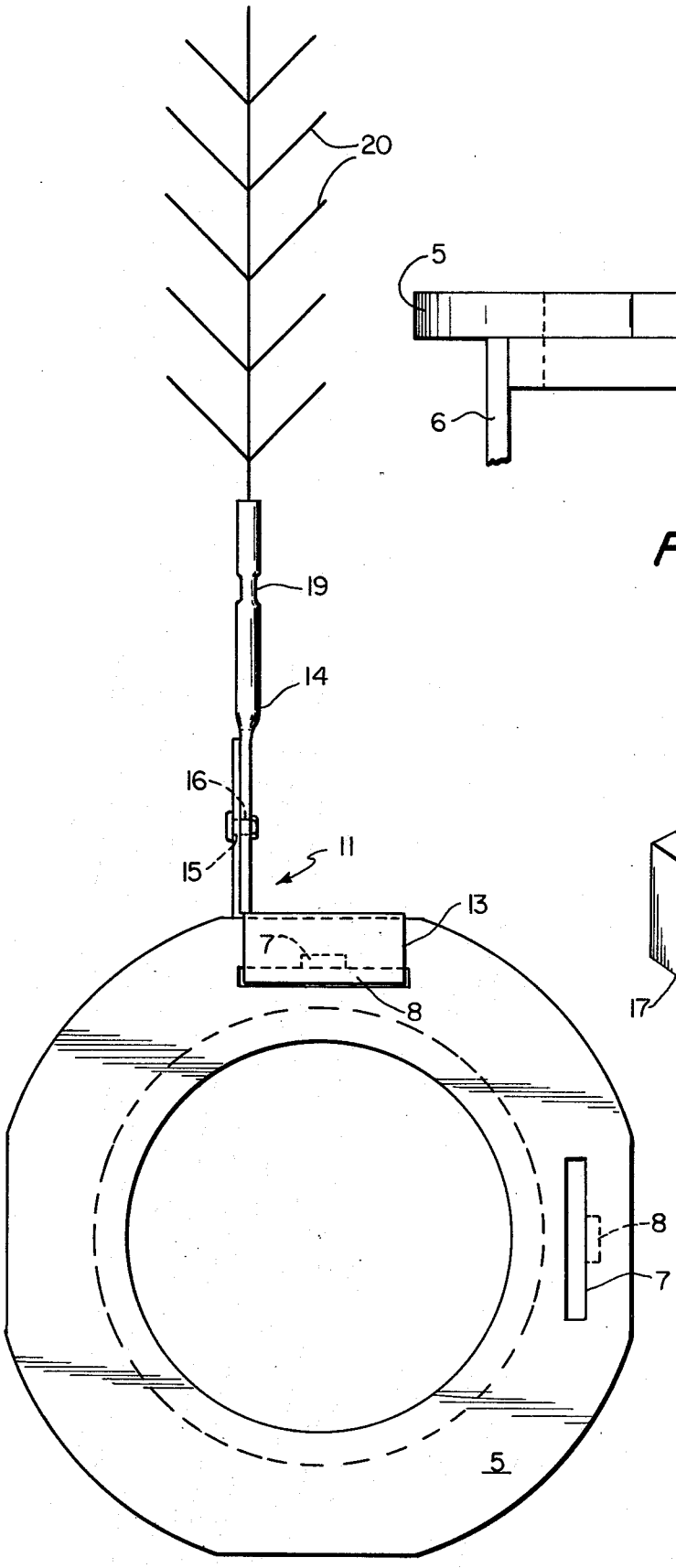
FIG. 3 is a top view of the support collar showing the hinge slot and locking notch as well as the hinge assembly and branch extending therefrom in a fully extended condition.
Figure 4:
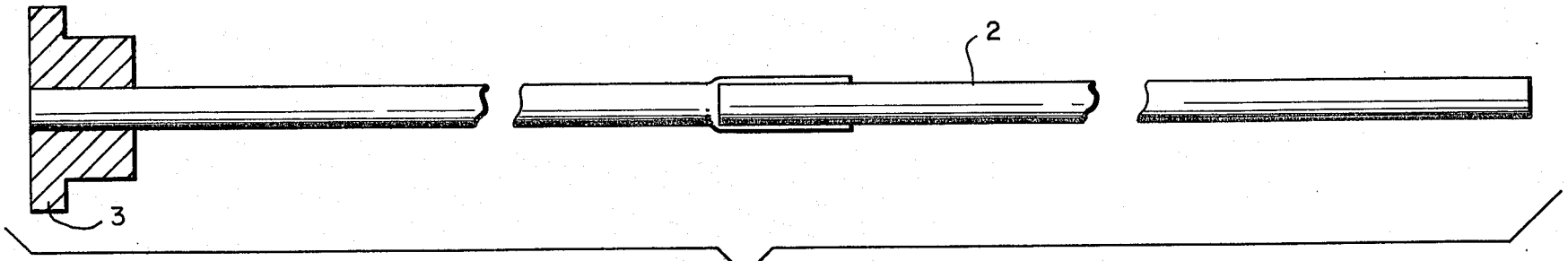
FIG. 4 is a side view of the support rod or tube and the base.
Figure 5:
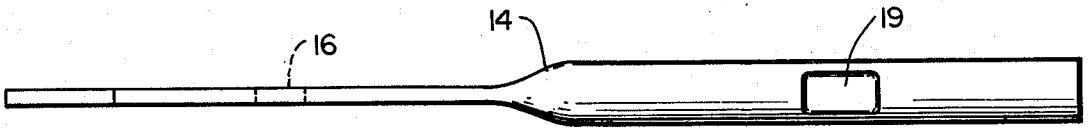
FIG. 5 is a top view of the hinge extension member.
Figure 6:
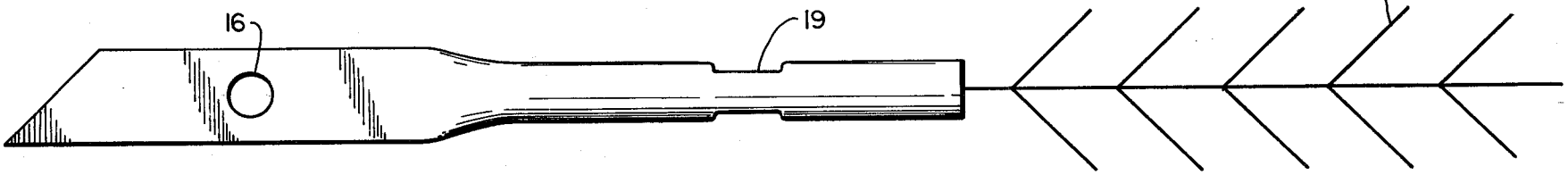
FIG. 6 is a side view of the hinge extension member showing the crimping slots.

In FIG. 8, numeral 12 refers to the hinge base 13 in a prefolded condition when just cut. Folding takes place along fold lines 12 to produce the finished base 13 in FIG. 11.

The support collar 5 is adhered to the top of each cylinder 4 and the cylinder 4 dimensions in length and diameter can be varied depending on the different height and size of the tree desired.

The stop ring 10 is molded to the end of each cylinder 4 respectively and the "O"-ring 9 is placed above the stop ring 10. The number of hinge slot 7 is varied on the support collar to accomodate the desired number of hinge assemblies 11 to vary the number of limbs 20 on the tree for appropriate fullness or the like.

An opening in the bottom of the base allows the support rod or tube 2 to push the end of the top cylinder 4 to its maximum height.

The performance of the present structure is outstanding not only due to its speed and convenience but due to the collapsable and compact character of the structure which permits easy and compact storage for shipping or between uses of the structure.

The present invention may be embodied in other specific forms without departing from the spirit or central characteristics thereof. Presently disclosed embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. An artificial tree comprising a display portion, a base member located therein having a support element extending therefrom, with a plurality of tubular elements surrounding said support member wherein the diameter of the tubular members decreases sequentially toward the support member, each tubular member having a support collar means adhered thereto wherein said support collar means contain a plurality of openings adapted to receive pivotal members to extend from said collars, each pivotal member having a locking tab located thereon and said support collar means contains a locking notch adjacent to each said opening adapted to receive one said locking tab.

2. An artificial tree according to claim 1 wherein the tubular elements are in spaced relation located axially and concentrically one within the other and are separated by a support member located in adjacent relationship to a stop means.

3. An artificial tree according to claim 2 wherein the pivotal member is a hinge element comprised of a hinge base adapted to be inserted into the one said opening in said collar and containing a rivet hole therein.

4. An artificial tree according to claim 3 wherein the hinge base has attached thereto a hinge extension in pivotal relationship therewith and adapted to receive limb members.

5. An artificial tree according to claim 4 wherein the support collar contains a projection member extending therefrom and adapted to be received in the space between adjacent tubular elements.

6. An artificial tree according to claim 5 wherein the hinge extension contains crimping slots adapted to receive said limb members.

* * * * *